US008668817B2

(12) United States Patent
Battisti

(10) Patent No.: US 8,668,817 B2
(45) Date of Patent: Mar. 11, 2014

(54) SYSTEM AND METHOD OF PLATING METAL ALLOYS BY USING GALVANIC TECHNOLOGY

(75) Inventor: Lorenzo Battisti, Trento (IT)

(73) Assignee: Creat New Technology S.R.L., Caldonazzo (IT)

( * ) Notice: Subject to any disclaimer, the term of this patent is extended or adjusted under 35 U.S.C. 154(b) by 608 days.

(21) Appl. No.: 12/680,790

(22) PCT Filed: Oct. 3, 2008

(86) PCT No.: PCT/IB2008/002612

§ 371 (c)(1),
(2), (4) Date: Mar. 30, 2010

(87) PCT Pub. No.: WO2009/044266

PCT Pub. Date: Apr. 9, 2009

(65) Prior Publication Data

US 2010/0221571 A1 Sep. 2, 2010

(30) Foreign Application Priority Data

Oct. 5, 2007 (IT) ..... TO2007A0704

(51) Int. Cl.
*C25D 21/12* (2006.01)
*C25D 21/18* (2006.01)

(52) U.S. Cl.
USPC ..... 205/81; 205/80; 205/82; 205/83; 205/101

(58) Field of Classification Search
USPC ..... 205/101, 145, 80–84
See application file for complete search history.

(56) References Cited

U.S. PATENT DOCUMENTS

| | | | | |
|---|---|---|---|---|
| 3,141,837 | A * | 7/1964 | Edelman | 205/82 |
| 3,296,100 | A | 1/1967 | Yonezaki et al. | |
| 3,634,211 | A | 1/1972 | Seyb | |
| 3,775,267 | A | 11/1973 | Yahalom | |
| 4,189,359 | A * | 2/1980 | Limare et al. | 205/256 |
| 4,461,680 | A * | 7/1984 | Lashmore | 205/104 |

(Continued)

FOREIGN PATENT DOCUMENTS

| | | |
|---|---|---|
| EP | 1403401 | 3/2004 |
| EP | 1717353 | 11/2006 |

(Continued)

OTHER PUBLICATIONS

Gelchinski M H et al: "Pulse Plating of Chromium-Cobalt Alloys Containing a Phase With the A-15 Structure".

(Continued)

*Primary Examiner* — Nicholas A Smith
*Assistant Examiner* — Brian W Cohen
(74) *Attorney, Agent, or Firm* — McGuireWoods LLP

(57) ABSTRACT

The invention relates to a system and a method of plating metal alloys, as well as to the structures thus obtained. The system for plating metal alloys comprises an electrolytic cell containing an electrolytic solution (3) in which an anode (4,4*a*,4*b*), a cathode (5), and a plurality of metal components to be plated onto the cathode are immersed, the anode (4,4*a*, 4*b*) and the cathode (5) being electrically connected to means (6) adapted to apply a potential difference between said anode (4,4*a*,4*b*) and said cathode (5). The invention is characterized in that the means (6) adapted to apply a potential difference between said cathode (5) and said anode (4,4*a*,4*b*) impose a potential difference value that changes over time according to a predefined law.

11 Claims, 1 Drawing Sheet

(56) References Cited

U.S. PATENT DOCUMENTS

| | | | | |
|---|---|---|---|---|
| 4,648,947 | A | 3/1987 | Naismith et al. | |
| 4,725,339 | A * | 2/1988 | Bindra et al. | 205/81 |
| RE34,191 | E * | 3/1993 | Brown | 205/96 |
| 6,482,298 | B1 * | 11/2002 | Bhatnagar | 204/194 |
| 6,793,794 | B2 * | 9/2004 | Hongo et al. | 205/96 |
| 6,835,294 | B2 * | 12/2004 | Tsuchida et al. | 205/98 |
| 2003/0044303 | A1 | 3/2003 | Chen et al. | |
| 2005/0189231 | A1 | 9/2005 | Capper et al. | |

FOREIGN PATENT DOCUMENTS

| | | | |
|---|---|---|---|
| GB | 469438 | | 7/1937 |
| GB | 1283024 | | 7/1972 |
| GB | 1381192 | | 1/1975 |
| GB | 2076855 | | 12/1981 |
| JP | 2000-160389 | A | 6/2000 |
| JP | 2002-004094 | A | 1/2002 |
| JP | 2005-247694 | A | 9/2005 |
| JP | 2006-146087 | A | 6/2006 |

OTHER PUBLICATIONS

Bindra P et al: "Pulse Plating of Alloys".
Dacuna B et al: "Preparation of COAG Electrodeposited Films".
Pawar S H et al: "Pulsce Electrodeposition of Y—Ba—Cu Alloyed Films From an Aqueous Bath".
Jovic V D et al: "Identification of Intermetallic Compounds in Electrodeposited Copper-Cadmium Alloys by Electrochemical Techniques".
Puippe, Jean-Claude and Leaman, Frank: "Theory and Practice of Pulse Plating".
International Search Report for PCT/IB2008/002612.
Written Opinion of the International Searching Authority for PCT/IB2008/002612.

* cited by examiner

SYSTEM AND METHOD OF PLATING METAL ALLOYS BY USING GALVANIC TECHNOLOGY

The present invention relates to a system of plating metal alloys by using galvanic technology and to an associated plating method, as well as to a structure plated by using said system and method.

The application field of the invention is that of galvanic technologies, in particular the plating of metal alloys onto the cathode of an electrolytic cell. More in general, the invention ld of cathode-plating galvanic technologies, several technologies of plating differelates to the field of technologies for producing metal alloys.

In the fierent binary alloys, such as Ni—Cr or Fe—Ni alloys for magnetic applications or Pb—Sn alloys for tribologic applications, have become widespread over time.

The literature also describes galvanic technologies of plating metal alloys made up of three or four components, which however have found no practical applications in the industry.

As a matter of fact, many problems arise when using galvanic technology to obtaining a simultaneous and constant deposition of a plurality of metal components onto the cathode while also maintaining a certain composition in weight. It is in fact necessary, but not sufficient, that all the various metals have similar electrochemical potential values. The potential of each component is also related to the respective superpotentials, to the concentration of the saline solution in the galvanic bath, to activity coefficients, to the presence of complexing agents in the solution, and to the physical conditions at the boundaries of the bath itself.

The galvanic technologies known in the art are based on the principle that the deposition of each metal component onto the cathode is implemented by controlling the galvanic bath supply current. The process is typically carried out by using electromotive means adapted to apply an appropriate electromotive force or potential difference between the cathode and the anode of the electrolytic cell, and means for controlling the electric features of the current supplied by said electromotive means, in particular the intensity of said current. Such means typically consist of an electric generator associated with a current rectifier which adjusts the intensity of the current flowing in the galvanic bath.

As known, in the case of a single metal element to be deposited onto the cathode, the potential difference applied between the anode and the cathode of an electrolytic cell is related to the current applied thereto according to the following simplified equation:

$$E_{cell}=E_{0,cell}+\eta_A-\eta_C+RI$$

where $E_{cell}$ is the potential difference applied to the cell, $E_{0,cell}$ is the counterelectromotive force, $\eta_A$ and $\eta_B$ are respectively the anodic and cathodic superpotentials of the metal, R is the electric resistance of the bath, and I is the current intensity. The counterelectromotive force $E_{0,cell}$ is the potential difference exerted by the pile made up of the anode-solution-cathode system, which is function of the concentration of both the reducing and the oxidizing components. In short, any concentration, current or voltage variations in the galvanic bath can affect the system balance and are related to one another by precise balance laws.

In the industrial practice, the plating process is adjusted by maintaining a wanted saline concentration in the galvanic bath through proper additions of metal salts during the plating process. These additions require the galvanic bath be regularly and constantly checked and adjusted.

The methods known in the art are based on the fact that, if current is fixed and the ratios among the concentrations of the metal components to be plated are kept at certain values, the potential difference will stay almost constant and the cathode plating process will take place in a sufficiently controlled and regular manner. The main reason for a fixed current being applied to the bath is that the current flowing through the bath can be directly related to the thickness and quantity of the metal depositing onto the cathode over time.

In the practical implementation of known galvanic technologies, which as aforementioned are based on controlling the bath supply current and saline concentration, it is very difficult to control the plating deposition in case of more than two metal components are to be plated, especially when anodes made of metal alloys are used. To give an idea of such difficulties, let it suffice to say that the addition of a single metal to a bath will affect the solubility of the other metals; therefore, effects which are thoroughly different from the expected ones may result by adding a metal to a solution.

Actually, when operating under imposed current, changes take place over time in the potentials and concentrations of the different metal components, which substantially cannot be kept at fixed values. It follows that the cathode metal deposition is characterized by layers having different compositions and a different degree of uniformity. Moreover, the potential difference variation occurring over time allows other electrochemical reactions to take place in the bath, e.g. parasitic or dissipative reactions, such as redox short circuits, which may put the system totally out of control.

In conclusion, known technologies are only partially effective when the plating process uses two metal elements, and they turn out to be ineffective when using three or more metal elements. In fact, by setting a density value for the current flowing through the galvanic bath it is possible to control the number of charges globally discharged onto the cathode, but not their qualitative and quantitative distribution, i.e. the respective proportions in weight which are necessary in order to create the wanted alloy.

On the whole, several problems of a strong impact on such known galvanic technologies arise, among which:

- solubility of the single metal components in solution;
- polarization phenomena, in particular anodic polarization;
- typology and electric features of the bath supply current;
- presence of metal elements with different oxidation numbers and electrochemical potentials.

A direct current supplied to the galvanic bath, for example, leads to the formation of column-like structures which will exfoliate after just a few microns of deposition due to the high internal tensions accumulated during the deposition process.

When we consider metal elements having different oxidation numbers, such as Fe and Cr, such elements require, in order to be plated, the presence of complexing agents, typically organic ones, for maintaining in the solution the most appropriate oxidation number for plating, generally the lowest one. In fact, if different redox systems are simultaneously present with regard to a metal element in solution, unwanted reactions may take place which sometimes would make plating impossible. For example, the simultaneous presence of $Fe^{3+}$ and $Fe^{2+}$ may cause current dissipation, since it is possible that an atom is oxidized on the anode and reduced on the cathode, thereby returning to its previous state without any deposition taking place, while also heating up the solution.

The present invention aims at overcoming the above-mentioned limitations of the prior art by providing a system and a method of plating metal alloys which will eliminate said limitations of the prior art while minimizing or even completely cancelling the effects of the above-listed problems.

It is an object of the present invention to perform a cathode plating process with two or more metal components by optimally controlling the percentages in weight of the obtained alloy, in particular when an alloy made up of three, four or more elements is to be obtained.

It is another object to carry out a plating process wherein it is possible to control the cathode deposition process of the metals in a simple and effective manner.

It is another object to carry out a plating process which, once started, takes place in a substantially automatic manner, i.e. without requiring any external control or adjustment, e.g. changes to the saline bath chemical composition.

It is a further object to obtain metal structures on the cathode which are characterized by low internal tension and excellent mechanical characteristics, in particular consisting of crystalline structures substantially void of impurities.

It is a further object to obtain structures on the cathode which have particularly complex and/or irregular shapes and excellent mechanical characteristics.

Said objects are achieved by the present invention by providing a system and a method of plating metal alloys having the features as set out in the appended claims, which are intended to be an integral part of the present description.

The present invention is based on the fundamental concept that the plating process is carried out under voltage control, in particular by imposing between the anode and the cathode of the electrolytic cell a potential difference having a value that changes over time according to a predefined law. This solution differs from all known plating processes, which control the intensity of the current flowing through the bath.

The law that defines the potential difference value over time depends on the alloy to be plated and on other parameters of the galvanic bath, e.g. pH and temperature. This allows to select the law which is most suited to the bath depending on the conditions at the boundaries.

Also, said law may prescribe that either a constant or a time-variable potential difference must be applied to the anode and the cathode of the electrolytic cell, depending on plating conditions and required performance.

Further objects and advantages of the present invention will become apparent from the following description and from the annexed drawings, wherein.

Figure 1:
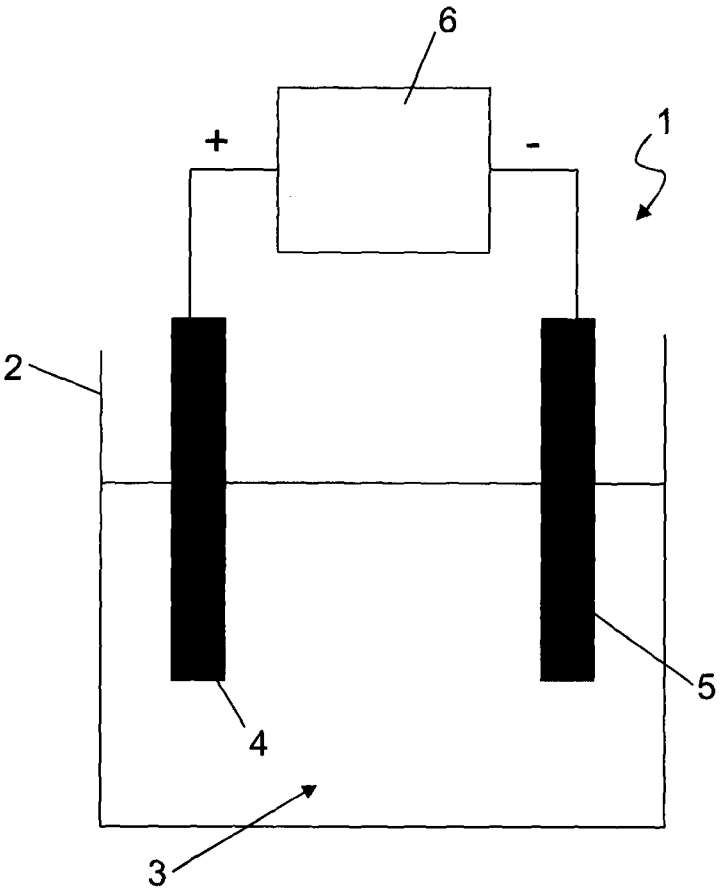
FIG. 1 shows a metal alloy plating system according to the invention, in particular an electrolytic cell.

With reference to FIG. 1, the electrolytic cell 1 comprises a tank 2 containing an electrolytic solution 3 which includes salts and/or acids in the appropriate quantity and composition for the plating to be obtained. A potential difference $E_{Cell}$ is applied to two electrodes immersed in the solution 3, i.e. an anode 4 and a cathode 5, through a direct voltage generator 6.

In a per se known manner, the generator 6 may consist of electromotive means and a voltage rectifier. For the purposes of the present invention, the generator 6 is preferably equipped with a control logic capable of adjusting the potential difference $E_{Cell}$ applied between the anode and the cathode. In particular, means are provided which are adapted to change the potential difference $E_{Cell}$ between the anode 4 and the cathode 5 over time, so that a potential difference that changes over time according to a predefined law can be imposed between the anode and the cathode. In other words, said means are operative during the plating process to the purpose of imposing said predefined law.

The potential difference imposed between the cathode and the anode is chosen, in particular, according to parameters, criteria and operating modes such as, for example:

I) the imposed potential difference value is such that each metal element of the wanted alloy can diffuse from the anode to the bath and can deposit itself onto the cathode;

II) the potential difference value is such that the metal elements to be plated can only diffuse into the bath when they are in the wanted oxidation state, which is usually the state corresponding to the lowest electrochemical potential;

III) physical distance between the anode and the cathode in the galvanic bath: the longer is this distance, the greater the potential drop occurring between the anode and the cathode, due to the resistance of the electrolytic solution of the bath;

IV) agitation of the electrolytic solution of the bath, i.e. solution mass flows: the greater is the agitation, the wider is the range of applicable potential differences leading to a successful plating process;

V) pH number of the electrolytic solution: a lower number allows to keep more easily the metal ions in solution, so avoiding any precipitates in the solution; however, this number must not drop below a certain value in order to prevent the liberation of gaseous hydrogen, which generates a reducing of the cathode efficiency;

VI) temperature of the galvanic bath: a higher temperatures increases the velocity at which the metal ions diffuse through the solution, while at the same time also increasing the size of the metal grains;

VII) concentration of the metals in solution: the higher is the concentration, the higher the currents and therefore the potential differences that can be applied to the galvanic bath;

VII) charge transfer superpotentials at the interfaces between the liquid of the electrolytic solution and the cathode, which depend on several factors, among which cathode composition and formation, metal elements to be diffused and transferred into the solution and their respective compositions in weight, and composition of the electrolytic solution.

For the plating system and method according to the invention being able to properly operate and control the process, it is preferable that the anode employed is a soluble one, even though it is nevertheless still possible to implement the process by using insoluble anodes. In particular, the soluble anode may advantageously be made of the same alloy as the one to be deposited, i.e. it may contain all, and only, the elements to be deposited, so that no unwanted metals can deposit onto the cathode and no slag can precipitate into the solution.

Furthermore, the anode may advantageously have the very same composition in weight as the metal alloy to be obtained onto the cathode, as will be further explained below.

The electrolytic solution of the galvanic bath may consist of a solution having an arbitrary composition of the elements to be plated, with the sole limitation that it must contain an adequate quantity of composition acids and complexing agents for the plating process to be carried out, in order to sustain those concentration ratios of the metal species to be plated which are necessary to depositing the alloy onto the cathode in the wanted percentage in weights and physical conditions. Its actual composition will be specified later on in the description of some examples of invention embodiment.

The cathode of the galvanic bath may consist of either a matrix made of metal material, onto which the electroformed coating of the plated metal alloy is deposited and to which said coating adheres permanently, or a conductive material from which the electroformed coating can be detached, thus obtaining a component having any shape.

Since the method described herein allows for depositing a few millimeters of material even in case of complex or irregular shapes, it is possible to obtain structures having particularly complex and/or irregular shapes and excellent strength characteristics.

In particular, the method and system according to the invention effectively and advantageously allow to coat a micro-perforated matrix for obtaining micro-porous structures, e.g. of the type described in patents GB2356684, U.S. Pat. Nos. 6,488,238 or 6,682,022, with a metal alloy having a wanted composition in weight, and in particular which is especially suitable for aeronautical applications, such as Hastelloy.

Means adapted to change the potential difference between the anode and the cathode of the electrolytic cell over time are adapted, in particular, to apply a potential difference that follows a law having a pulsed nature, i.e. a potential difference that follows, at least for a certain period of time, a pulse-like or step-like law with respect to the time variable, as clearly illustrated and exemplified below.

Advantageously, this causes a cathode deposition of crystalline, in particular micro-granular metal structures, which are free from internal stresses and offer excellent mechanical characteristics.

Advantageously, the potential difference variation law applied between the anode and the cathode may be of any kind, i.e. either constant or variable within a certain period of time, provided that it is previously established.

Said anode-cathode potential difference variation law may advantageously be repeated cyclically for a time period T equal to a fraction or to the entire length of the plating process.

According to a preferred embodiment, said law can be expressed as follows:

$$\begin{cases} E_{Cell} = E_{Cell,b} & \text{for } n(t_1 + t_2) < t < (n+1)t_1 + nt_2 \\ E_{Cell} = E_{Cell,b} + \Delta E_{Cell} & \text{for } (n+1)t_1 + nt_2 < t < (n+1)(t_1 + t_2) \end{cases} \quad (1)$$

where $t_1$ is the length of a time interval in which the potential difference is kept at a lower level $E_{Cell,b}$, $t_2$ is the length of the time interval in which the potential difference is kept at a higher level $E_{Cell,b}+\Delta E_{Cell}$, and n is an integer between 0 and $(T/(t_1+t_2))-1$.

In other words, (1) indicates that the potential difference $E_{Cell}$ to be applied consists only of the basic potential difference $E_{Cell,b}$ for a time $t_1$, followed by a voltage pulse $\Delta E_{Cell}$ having a duration $t_2$.

Such a pulse-like trend is found in every time interval $t_1+t_2$ that follows ($n\neq 0$); therefore, it follows that for a new time $t_1$ the applied potential difference returns to the value $E_{Cell,b}$ and then, in the next time interval $t_2$, it goes back again to the value $E_{Cell,b}+\Delta E_{Cell}$ and so on, for the entire duration of the period T.

The values of these times $t_1$ and $t_2$ are related to each other through a time constant $\tau=t_2/(t_1+t_2)$ which determines the time ratio between the duration of each pulse and the overall length of the period of the pulse-like law.

Tests have shown that the choice of the constant $\tau$ can affect the successful outcome of the process, i.e. by obtaining a plating having a crystalline grain with particularly good mechanical characteristics, depending on the different alloys to be plated onto the cathode.

The $E_{Cell,b}$ and $\Delta E_{Cell}$ factors may be constant with respect to time, as in the following examples of embodiment of the invention, or they may be any functions which are dependant on the time variable.

The method according to the invention imposes a basic potential difference value $E_{Cell,b}$ chosen according to any of the above points I)-VIII).

According to the invention, the plating process is divided into two stages, i.e. an initial stage, called "training stage", and a plated structure production stage. The first training stage is characterized by a chemical imbalance situation.

The imposition of a potential difference between the cathode and the anode as defined by law (1) determines concentration and activity values of the ionic species of the metals included in the galvanic bath, which are variable over time with respect to the initial conditions. In fact, as can be evicted from Fick's diffusion laws, the galvanic bath has a dynamic behaviour because, when the concentration of a generic metal ion in solution grows, the speed of dissolution of that metal from the anode decrease, while its speed of deposition onto the cathode will increase. In this stage, the quantity of charges depositing onto the cathode for each metal will depend on the instantaneous concentration conditions of the respective metal ions in solution.

Preferably, this initial stage of the plating process is conducted by using a cathode, called training cathode, onto which the various ligands, i.e. the components of the deposited metal alloy, deposit in ratios which are generally different from the wanted ones and following compositions in weight changing over time.

During this training stage, each cation in solution progressively reaches a stationary flow condition, characterized in that the ratios between the concentrations of the single elements stay constant over time.

This implies that the speed of dissolution of the metal cations, which are considered to be produced at the anode, equals the speed of deposition of the anions onto the cathode. This condition is true when there are no collateral reactions that decrease the cathode deposition efficiency of the plating process, such as, for example, the reaction that releases gaseous hydrogen. In such a case, while it is still true that the metal will deposit onto the cathode with the wanted composition in weight, the concentration of each metal however tends to grow over time due to the release of gaseous hydrogen.

The production of gaseous hydrogen causes a higher pH and a solution composition variation, which requires to be checked and corrected over time by adding water and acid in appropriate proportions. If not corrected, this phenomenon actually leads the solution to saline saturation, with unwanted metal salt precipitation and the setting of time-stable concentration ratios among the various metal species, characterized by ratios in weight which are unsuitable to obtain the wanted plating.

This problem can be prevented by including electrolytic solution agitation means, e.g. a centrifugal pump, in particular having the outlet directed towards the cathode of the electrolytic bath. Advantageously, a strong agitation of the electrolytic solution allows to keep the global concentration of the metal ions in solution within a certain range of appropriate values ensuring a perfect cathode plating process.

An even more effective system to the purpose of preventing the metal concentrations in solution from growing over time is the artificial production of hydrogen ions in the same number as those discharged onto the cathode and thereon released in gaseous form. To this end, a suitable means consists of an auxiliary anode, hereafter referred to as compensating anode, which may be either soluble or insoluble depending on the bath chemism, and which is connected in parallel to the bath anode. The function of said compensating anode is to generate $H^+$ ions in the same number as those discharged onto the cathode and released in gaseous form, by taking the necessary current, called compensation current, from the anode in the manner described below. This allows to keep constant the concentration of the $H^+$ ions in solution, and therefore also the pH number thereof. From a practical viewpoint, the current that must flow through the compensating anode is experimentally determined by measuring the cathode efficiency when no current intensity flows to the compensating anode, i.e. with the compensating anode being not inserted in the electrolytic solution. Cathode efficiency is measured by monitoring the plating process for a certain time interval, in particular by measuring the masses of the anode and cathode in order to calculate the difference between the bigger mass dissolved from the anode and the smaller mass deposited on the cathode. This mass difference is directly related to the electric current used in the solution for discharging the $H^+$ ions onto the cathode, which does not translate into metal deposit. Once the value of this current has been calculated, the compensating anode is dimensioned with an electric resistance such that the exact compensation current will be generated in the bath, i.e. the current that is used in the bath for discharging the $H^+$ ions and that will not anymore be used for the dissolution of metals from the anode. Thus, once the compensation anode has been dimensioned as described, the system will be in conditions wherein the anodic metal dissolution current is equal to the cathodic metal deposition current.

Electrodes made of graphite or coal may preferably be employed as compensating anodes, which can advantageously be used in any type of galvanic bath.

At the end of a training period, in the absence of any parasitic reactions, the cathode deposition speeds of the single metals is equal, in an absolute sense, to the anode dissolution speeds, and the solution is balanced as well. When the process is carried out in conditions of gaseous hydrogen release, the anodic currents of the metals will be higher than their cathodic currents according to a coefficient which is the same for all elements. The deposition of the single metals will still take place according to the same ratio in weight, but with hydrogen release. In any case, the condition of balanced solution without hydrogen release is to be preferred; in particular, this condition is accomplished by adjusting the bath acidity to a value which is not too high, and through a strong agitation of the solution and/or by using compensating anodes.

The training stage ends as soon as a stationary situation is achieved, wherein the concentration ratios of the metal ions to be plated in solution no longer changes; the solution is now balanced and the actual plating stage can be carried out.

The training cathode is then removed and replaced with the one onto which the wanted alloy will have to deposit.

Subsequently, a potential difference also following a predefined law, which is preferably identical to that used in the training stage, is applied between the anode and the cathode.

Preferably, the plating method according to the invention is implemented after the following preliminary steps have been completed:

the composition of the wanted alloy is analysed in terms of quantity and quality of the metal elements or components to be plated onto the cathode, in particular by noting the standard electrochemical potentials of the single metal elements;

the basic potential difference $E_{Cell,b}$ at which the galvanic bath must operate is determined: typically, this corresponds to the most negative potential among the range of electrochemical potentials of the elements to be plated (e.g. the potential of chrome Cr in Hastelloy plating, with reference to the following example 1) is taken as a reference and used as a minimum basic potential difference at which the first attempt will be made. If no current flows, then the value of the basic potential difference will be increased gradually, in particular according to preset increments, until it is ascertained, by using known methods, that all the wanted anodic elements are present in the solution (to this purpose, a solution called "blank solution" is used, which includes all the elements of the bath except metals. By doing in this way, it will be easy to verify the anode dissolution with known means);

it is checked whether any parallel reactions occur in the bath in addition to the electrodeposition one, e.g. reactions between Fe—Cr in the aforementioned example 1;

based on the above check, the galvanic bath composition is determined and prepared, in terms of quantity and type of acids, complexing agents and salts of metals to be plated, so that the pH of the electrolytic solution is adjusted to a predefined value;

the galvanic bath tank is fitted out and prepared according to known procedures;

the anodic and cathodic treatment of the bath is implemented by subjecting the anode and the cathodic matrix, respectively, to pickling operations, in particular by using the electrolyte in order to avoid any contamination; said operations take place in separate baths for the anode and the cathode;

a training cathode is inserted into the tank.

The electrolytic cell with its galvanic bath is prepared in this manner before starting the cathode plating process for the wanted alloy, which is typically implemented by following the method described above, which comprises the following steps:

a) applying a potential difference between the anode and the cathode in the galvanic bath according to a predefined law, e.g. the above-mentioned law (1), which includes periods wherein the applied potential difference is only equal to the basic potential difference and other periods wherein a pulse having a predefined width is added to said basic potential difference, e.g. 50% of the basic potential difference, as shown in example 1 below;

b) verifying the achievement of a condition in which the concentration ratios of the metal ions to be plated in the solution do not change over time, the condition being named as "balanced solution", i.e. when it is possible to start plating the wanted metal composition;

c) extracting the training cathode from the galvanic bath and inserting thereinto a cathodic matrix onto which the alloy is to deposit, advantageously keeping the same bath potential difference as in the previous steps;

d) maintaining the predefined potential difference law until the alloy has completely and/or as wanted deposited onto the cathode.

In the present description, the term "cathodic matrix" generally refers to any conductive or semiconductive structure or element onto which the alloy to be obtained in the process must be plated.

In the advantageous case wherein a compensating anode is used, an additional step is also implemented for generating $H^+$ ions in the bath electrolytic solution in the same number as those discharged onto the cathode and released in gaseous form, taking the necessary compensation current from the anode as explained above.

With reference to step a), the potential difference between the anode and the cathode is set according to the above-described preliminary steps.

In their practical implementation, said preliminary steps require that a potential difference be applied between the anode and the cathode by starting from an initial potential difference value chosen as described above, the value being increased until current circulation and all the wanted elements dissolving from the anode is verified. The attainment of such a condition determines the value of the basic potential difference to be applied to the galvanic bath. Also, the potential difference variation law over time must be such to ensure optimum dissolution and deposition, respectively from the anode and onto the cathode, of the metal elements that make up the alloy to be deposited. Advantageously, in general terms the law above described is excellent from this point of view as well.

When, during step d), the applied potential difference stays constant over time, the electrolytic solution will be saturated and balanced, and a controlled and uniform deposition of the metals will take place on the cathode, in particular in the very same proportions in weight as those existing on the anode, if the anode is a soluble one.

Preferably, step d) is implemented by applying a potential difference value between the anode and the cathode which changes over time according to the same law as the one used for the potential difference applied during the training stage. However, other laws may also be applied during step c), different from those of step a).

If nevertheless one should want, during step c) of the method, to carry out the plating process under constant-current control (as taught per se by the prior art), e.g. by using a current value which can be deduced by measuring the previously imposed potential difference, one would run into considerable risks in terms of plating results over time. In fact, since current is related to concentrations and potential difference, it is apparent that any incidental modification of any parameters affecting the plating process would imply the risk of losing control over the ratio in weight and deposition uniformity of the metal elements depositing onto the cathodic matrix, just as it happens with known technologies. This risk increases with deposition thickness, i.e. as time passes during the plating process.

Due to the above reasons, it is apparent that it is important, in order to implement the plating method according to the invention, to impose a potential difference between the anode and the cathode of the galvanic bath according to a predefined law, i.e. to only control this electric feature, and no other bath parameter.

In particular, the best result in terms of process effectiveness is obtained when the control is accomplished through a law that prescribes that a preset potential difference is to be applied between the anode and the cathode for the entire plating process, which would otherwise suffer from transients that would make it difficult to control the plating and the bath phenomena generating therefrom.

In summary, when the electrolytic solution is in balanced conditions, the galvanic bath reaches a ratio among the concentrations of the single cations of the metals to be plated which is stable over time and which can be used for plating the alloy until the anode is completely dissolved, the anode being a soluble one.

It is also clear that the choice of the initial concentrations of the metals in solution and of their reciprocal ratios is a marginal factor for a successful implementation of the method, since the initial solution may consist only of acids and complexing agents at a certain pH value, i.e. with no metal salts dissolved in ionic form. Advantageously, by using only acids and suitable complexing agents it is possible to obtain a deposition void of any of those impurities which are typical of metal salts; also, it promotes metal solubility.

According to another important aspect of the present invention, the control over the concentration of the metal ions in solution during the plating process definitely turns out to be of minor importance than in prior-art systems. In fact, the currents generated in the galvanic bath follow the evolution of the various concentrations which, being in constant reciprocal ratios, generate current intensity ratios which are constant as well.

Therefore, the system and method according to the invention prove to be self-consistent, i.e. the galvanic bath has self-saturation properties in terms of absolute values of current density of the single cations and of the ratios thereof, which are mutually related through the mass percentages depositing onto the cathode. In other words, the system electrochemically evolves through a potential difference imposed between the anode and the cathode until it reaches a thermodynamic and electrochemical balance state which ensures equal anode dissolution and cathode deposition speeds at any time for each metal involved. In particular, when the anode advantageously provides the same composition in weight as the alloy to be deposited, it is possible to attain considerable plating thicknesses because the anode completely dissolves in solution, thus providing the greatest mass flow supply.

After a certain time from start-up, with the system according to the invention in a stationary condition, it is no longer necessary to correct the ionic concentration of the metals to be plated, since the system has reached a balance among the various ratios thereof which remain constant over time (balanced solution condition), nor the plating process requires any other adjustments.

The plating system and method according to the invention, wherein a potential difference is imposed between the anode and the cathode of the galvanic bath, advantageously allows to select the cationic species to be deposited onto the cathode, because the applied potential difference represents an actual energy barrier which cannot be crossed by certain species. This advantageously allows to prevent the formation of compounds having a high oxidation number, which would otherwise interfere in several ways with the galvanic bath and the plating process, e.g. like chromates, manganates or $Fe^{3+}$ based compounds. Furthermore, any deposition of impurities onto the cathode is successfully prevented, which might have unfavourable effects on the final mechanic or electromagnetic properties of the plated alloy.

In accordance with the method of the invention, a metal alloy can be plated onto the cathode even by using electrolytic solutions comprising the wanted concentrations of the metals to be plated and by using insoluble anodes, once the solutions have proven to be balanced. However, the outcome will not be wholly satisfactory over time, due to the progressive exhaustion of the metal cations in solution, resulting in solution balance variations. It follows that, with insoluble anodes, it is much more difficult to plate thick alloy layers while at the same time preserving the pure crystalline structure of the deposited material.

In conclusion, the present invention is successful in obtaining, on the cathode of the galvanic bath, a crystalline metal structure particularly free from impurities and having excellent mechanical characteristics, which are much superior to those of an analogous structure obtained through a thermoforming process.

It also allows to obtain a large number of metal alloys having many different compositions in weight, even those which cannot be obtained by the means of thermoforming techniques. The invention therefore opens the path to a new metallurgy, consisting of metal alloys with percentages in weight never implemented before.

Furthermore, the plating process takes place in a substantially automatic manner after the training stage, i.e. with no need of continuously monitoring the process in order to change the bath parameters, unlike the galvanic methods known in the art.

Further objects, features and advantages of the present invention will become apparent from the following detailed description of some preferred, but non-limiting, embodiment examples.

EXAMPLE 1

A metal alloy for aeronautical applications, called Hastelloy and containing the basic components listed in Table 1, is to be obtained on the cathode of a galvanic bath.

| Alloy element | Min. % in weight | Max. % in weight |
|---|---|---|
| Cr | 20.5 | 23.0 |
| Co | 0.5 | 2.5 |
| Mo | 8.0 | 10.0 |
| Fe | 17.0 | 20.0 |
| W | 0.2 | 1.0 |
| Ni | Remaining % in weight | |

The initial electrolytic composition of the galvanic bath and its electrical and physical parameters are those shown in the following Table 2:

| Galvanic bath composition | g/l |
|---|---|
| Ni (total sum of compounds) | 70 |
| $NiSO_4 6H_2O$ | 242 |
| $NiCl_2\ 6H_2O$ | 68 |
| Boric acid | 30.0 |
| $FeCl_2 6H_2O$ | 6 |
| TEA (Triethanolamina) | 60 |
| HCit | 6 |
| HCl at 33% | to pH <0.5 |
| **Bath parameters** | **measured value** |
| Temperature | 20-50° C. |
| Basic potential difference $E_{Cell,\ b}$ | 2.5-3 V |
| Width of pulse $\Delta E_{Cell}$ | 50% of $E_{Cell,\ b}$ |
| Pulse time constant $\tau$ | 0.23 |
| Anode/cathode surface ratio | >2.5 |

The potential difference law imposed on the galvanic bath has a pulsed nature and follows the time law (1) as described above, i.e.:

$$\begin{cases} E_{Cell} = E_{Cell,b} & \text{for } n(t_1 + t_2) < t < (n+1)t_1 + nt_2 \\ E_{Cell} = E_{Cell,b} + \Delta E_{Cell} & \text{for } (n+1)t_1 + nt_2 < t < (n+1)(t_1 + t_2) \end{cases}$$

Said law has been applied for a time T equal to the entire duration of the plating process, including the solution training period.

In this example, the galvanic bath employs an anodic electrode to be dissolved, which is made of the same alloy as the one to be deposited onto the cathode and in the exact percentages in weight, in particular obtained by thermoforming or casting. As can be seen, for the purpose of controlling the deposition, in particular of chrome Cr and iron Fe, the process uses Triethanolamina and HCit as respective complexing agents, boric acid as a pH buffer, and hydrochloric acid as necessary to obtain a pH value of the electrolytic solution lower than 0.5. The plating process has been carried out by following the steps a)-d) of the method as previously described, obtaining on a cathodic metal matrix the deposition of Hastelloy having excellent purity and mechanical strength behaviours.

By following the galvanic technology according to the present invention, it has been possible to plate a metal alloy having as many as six distinct metal components; this result has never been achieved by using any known technology.

EXAMPLE 2

This example relates to a bronze alloy (Cu, Sn) for tribologic applications, the exact composition of which has been omitted for simplicity. The following Table 3 lists the components of the galvanic bath and the values of the electric parameters applied thereto:

| | g/l |
|---|---|
| Galvanic bath composition | |
| Tin fluoborate (II) | 150 |
| Copper fluoborate (II) | 40 |
| TEA | 100 |
| Fluoboric acid | 100 |
| Boric acid | 30 |
| Hydrochloric acid | to pH 1-0.5 |
| Bath parameters | |
| Temperature | 15-50° C. |
| Basic potential difference $E_{Cell,\ b}$ | 0.5 V |
| Width of pulse $\Delta E_{Cell}$ | 70% of $E_{Cell,\ b}$ |
| Pulse time constant $\tau$ | 0.23 |
| Anode/cathode surface ratio | >3 |

In the above-detailed bath, fluoboric acid and boric acid are used in order to lower the pH of the solution as well as to act as complexing agents of tin Sn and copper Cu. An anodic electrode made of the same bronze alloy to be obtained is used.

The potential difference implementation law applied to the bath is identical to the one illustrated for the preceding example, and it is likewise applied for the entire duration T of the plating method.

Among the peculiarities of this bath, the cathode needs to be inserted into the bath under voltage, i.e. in the so-called "live mode", in order to avoid a preferential, non-adhering deposition of copper compared to tin.

It is clear that many changes may be made by technicians skilled in the art to the metal alloy plating system and method according to the invention as described in the appended claims; it also clear that in the practical implementation of the invention the illustrated details may have different shapes or be replaced with other technically equivalent elements.

For example, a metal alloy can advantageously be plated onto the cathode of a galvanic bath by using a bath which comprises a plurality of soluble anodes made of single metals to be plated, or of alloys thereof, wherein the cations of the alloy to be deposited onto the cathode are obtained from each anode dissolving separately.

Figure 2:
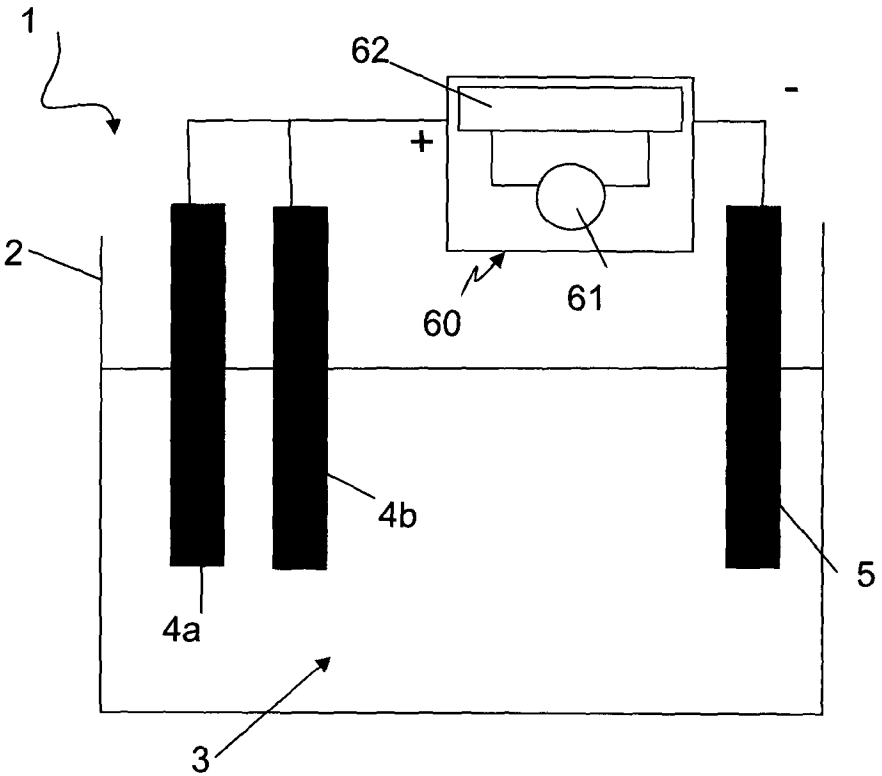
FIG. 2 shows a variant of the system of FIG. 1, in particular an electrolytic cell fitted with a plurality of anodes.

An example of such a variant will now be described with reference to FIG. 2, which shows a cell 1 that comprises a tank 2 containing a bath 3 in which two anodes 4*a*, 4*b* and one cathode 5 are immersed. The anodes 4*a*, 4*b* are electrically connected in parallel to an electric circuit 60 fitted with means 61 for controlling the potential difference supply provided by suitable electromotive means 62, so that the anodes 4*a* and 4*b* have the same potential as the galvanic bath. This parallel electric connection prevents an anode from behaving like a cathode towards the other anode, which would result in unwanted deposits on the anodes themselves.

Advantageously, this variant provides control over the anodic dissolution process of every single metal in solution, since it allows to obtain predetermined bath compositions and cathode alloy plating compositions by changing, for example, the number of anodes for each metal to be plated or the electric resistance of the single anodes, thus generating the wanted electric currents for each metal component of the alloy to be plated.

In addition, the solution using a plurality of anodes allows to maximise the ratio between the anodic surface and the cathodic surface of the bath, thereby improving the dissolution of the anodes in solution, increasing the concentration in solution of the respective salts and thus the respective diffusion towards the cathode, and increasing the overall effectiveness of the entire plating process.

A further variant of the plating system and method according to the invention includes means for purifying the saline solution which comprise, for example, pumping means, which may advantageously be the same ones that participate in the agitation of the electrolytic solution, having an inlet in fluid connection with a wall on the electrolytic cell side, preferably the bottom thereof, and selectively associated with filtering means. Advantageously, said purification means are adapted to collect and filter any impurities deposited on the bottom of the electrolytic cell, thus eliminating any risk of contamination of the cathode alloy deposition process.

The invention claimed is:

1. A method of plating metal alloys, comprising the steps of:

immersing at least one electrically conductive cathode and one electrically conductive anode into an electrolytic solution and supplying a potential difference between said at least one electrically conductive cathode and one electrically conductive anode for the purpose of depositing a plurality of metals for forming an alloy on the cathode, the applied potential difference having a value that follows a predefined law over time;

prior to immersing said cathode into the electrolyte solution, immersing a training cathode into said electrolyte solution and applying the potential difference between the at least one anode and training cathode such that when the concentration ratios of said metals in the solution do not change over time, the training cathode is removed from the solution and the cathode is inserted; and applying the potential difference until the deposition is complete.

2. The method according to claim 1, wherein said potential difference between said at least one anode and said training cathode is the same as said potential difference applied between said at least one anode and said cathode onto which said alloy is to be deposited.

3. The method according to claim 2, characterized in that said law has a pulsed nature.

4. The method according to any one of claims 1 to 3, wherein said at least one anode has the same composition in weight as the metal alloy to be deposited onto the cathode.

5. The method according to any one of claims 1 to 3, further comprising the step of generating H+ ions in the same number as those released in gaseous form within the electrolyte solution in order to keep a constant concentration of H+ ions.

6. The method according to claim 5, wherein the step of generating H+ ions is implemented by supplying a preset compensation current to a compensating anode.

7. The method according to any one of claims 1 to 3, characterized in that said metals to be deposited comprise at least three different chemical elements.

8. The method according to claim 4, wherein said anode is a soluble anode.

9. The method according to claim 1, further comprising agitating said solution and purifying said solution, to collect and filter any impurities depositing in an electrolytic cell containing said electrolytic solution.

10. The method according to claim 6, wherein said compensating anode comprises graphite or coal.

11. The method according to claim 6, wherein said compensating anode is insoluble in said solution.

* * * * *